US009527103B2

(12) United States Patent
Lin

(10) Patent No.: US 9,527,103 B2
(45) Date of Patent: Dec. 27, 2016

(54) FLAMELESS CANDLE DEVICE WITH FOUNTAIN

(71) Applicant: Mou-Li Lin, Tainan (TW)

(72) Inventor: Mou-Li Lin, Tainan (TW)

( * ) Notice: Subject to any disclaimer, the term of this patent is extended or adjusted under 35 U.S.C. 154(b) by 0 days.

(21) Appl. No.: 14/657,094

(22) Filed: Mar. 13, 2015

(65) Prior Publication Data

US 2016/0263613 A1 Sep. 15, 2016

(51) Int. Cl.

| | |
|---|---|
| ***F21S 8/00*** | (2006.01) |
| ***B05B 17/08*** | (2006.01) |
| ***F21V 33/00*** | (2006.01) |
| ***F21S 10/04*** | (2006.01) |
| ***F21V 3/02*** | (2006.01) |
| ***F21S 9/02*** | (2006.01) |
| ***F21V 23/04*** | (2006.01) |
| *F21W 121/02* | (2006.01) |
| *F21Y 101/02* | (2006.01) |

(52) U.S. Cl.

CPC ..... *B05B 17/08* (2013.01); *F21S 9/02* (2013.01); *F21S 10/04* (2013.01); *F21V 3/02* (2013.01); *F21V 23/04* (2013.01); *F21V 33/00* (2013.01); *F21W 2121/02* (2013.01); *F21Y 2101/02* (2013.01)

(58) Field of Classification Search

CPC . F21W 2101/02; F21W 2121/02; F21V 33/00; F21V 23/04; F21V 3/02; F21S 10/04; F21S 9/02; B05B 17/08

USPC ..... 239/16–18, 20, 22, 23

See application file for complete search history.

(56) References Cited

U.S. PATENT DOCUMENTS

| | | | | |
|---|---|---|---|---|
| 4,806,392 A * | 2/1989 | Dixon | ..... | F21S 10/002 239/18 |
| 6,755,349 B2 * | 6/2004 | Beidokhti | ..... | B05B 17/08 239/16 |

* cited by examiner

*Primary Examiner* — Jason Boeckmann

(74) *Attorney, Agent, or Firm* — Rosenberg, Klein & Lee

(57) ABSTRACT

A flameless candle device with a fountain includes a container, a light-emitting member, and a pump motor. The container has an outer wall to surround an accommodation space. The accommodation space is divided into a first half portion and a second half portion by a partition. The first half portion is in communication with the second half portion through an opening. The partition has a flange thereon. The accommodation space is adapted to accommodate a fluid, such as water. The light-emitting member is located in the accommodation space. The pump motor is in communication with the first half portion and the second half portion. When the pump motor is activated, the water flows from the first half portion to the second half portion, alternatively, from the second half portion to the first half portion. The present invention provides an illumination effect as well as visual and auditory enjoyments.

17 Claims, 5 Drawing Sheets

FLAMELESS CANDLE DEVICE WITH FOUNTAIN

BACKGROUND OF THE INVENTION

1. Field of the Invention

The present invention relates to a flameless candle device with a fountain, and more particularly to a flameless candle device which utilizes light penetrating flowing water to present a change of light and shadow and the flowing water passing a flange to fall like a waterfall, providing visual and auditory enjoyments.

2. Description of the Prior Art

In early times, a candle functions as a light-emitting illumination purpose. In recent years, it has become an illumination apparatus to enhance enjoyment of life, such as table lamps, display lights, and so on. Besides, a light-emitting member, such as LED, combined with a candle-like shell is developed. It is not necessary to light the candle any more when in use. The improved candle is more environmentally friendly and can save costs, commonly known as a flameless candle.

A flameless candle structures as disclosed in U.S. 20130223043 "Flameless Candle with Integrated Fountain". This structure utilizes a light-emitting member to illuminate. The light penetrates the flowing water to form a change of light and shadow.

However, the flameless candle only provides an illumination function. It is dull when in use.

SUMMARY OF THE INVENTION

The primary object of the present invention is to provide a flameless candle device with a fountain, providing an illumination effect as well as visual and auditory enjoyments.

According to one aspect of the present invention, the flameless candle device with a fountain comprises a container, a light-emitting member, a pump motor, and a power supply. The container has an outer wall to surround an accommodation space therein. The accommodation space is divided into a first half portion and a second half portion by a partition. The first half portion is in communication with the second half portion through an opening. The opening and a bottom of the container have a height difference. The partition has a flange thereon. The flange and the bottom of the container have a height difference. The light-emitting member is located in the accommodation space. The pump motor is in communication with the first half portion and the second half portion of the accommodation space. The power supply is electrically connected with the light-emitting member and the pump motor.

In some embodiments, the outer wall has a height higher than that of the partition.

In some embodiments, the outer wall has a height lower than that of the partition.

In some embodiments, the partition is an encircling closed configuration, rendering the first half portion and the second half portion concentric. The flange faces the first half portion, or alternatively, faces the second half portion.

In some embodiments, a connecting rope is provided. One end of the connecting rope is connected with a floating decoration and another end of the connecting rope is fixed to the container, so that the floating decoration is located in the first half portion of the accommodation space.

In some embodiments, the partition is narrowed downward. The light-emitting member is located in the second half portion close to a narrower portion of the partition. Another light-emitting member is disposed in the first half portion close to the opening.

In some embodiments, a flame-shaped transparent or translucent shell is provided above the light-emitting member disposed in the first half portion close to the opening.

In some embodiments, an outer edge of the flame-shaped transparent or translucent shell is provided with a dish-shaped transparent or translucent shell.

In some embodiments, the outer wall of the container and the partition are light-permeable.

In some embodiments, the power supply comprises a battery.

In some embodiments, the light-emitting member is a light-emitting diode.

In some embodiments, a switch is connected between the power supply and the light-emitting member and connected between the power supply and the pump motor. Preferably, the switch comprises a timer.

In some embodiments, a fluid is poured into the accommodation space, and the fluid is mixed with essence.

In some embodiments, a bubble generator is provided in the accommodation space.

In order to store the power supply conveniently and to integrate the components with the power supply, according to another aspect of the present invention, the flameless candle device with a fountain comprises a container, a light-emitting member, a pump motor, and a power supply. The container has an outer wall to surround an accommodation space therein. The accommodation space is divided into an upper space and a lower space by a first partition. The upper space is divided into a first half portion and a second half portion by a second partition. The first half portion is in communication with the second half portion through an opening. The opening and the first partition of the container have a height difference. The second partition has a flange thereon. The flange and the first partition of the container have a height difference. The light-emitting member is disposed on the container and located in the upper space. The pump motor is disposed on the container and located in the upper space. The pump motor is in communication with the first half portion and the second half portion. The power supply is disposed on the container and located in the lower space. The power supply is electrically connected with the light-emitting member and the pump motor.

Compared to the prior art, the present invention has obvious advantages and beneficial effects as follows:

1. The present invention utilizes the light penetrating the flowing water to present a change of light and shadow and the flowing water passing the flange to fall like a waterfall. The present invention provides visual and auditory enjoyments.

2. Through a different arrangement of the partition in conjunction with the flange to face the first half portion or the second half portion, the present invention can provide a different water flow effect and a different change of light and shadow to enhance a great diversity of the products of the present invention.

3. The container is connected with a floating decoration, such that the floating decoration can flow along with the water flow to increase the enjoyment of use.

4. The running time of the motor and the light-emitting member can be set by using a timer to provide energy-saving and eco-friendly effects.

5. The container is divided into an upper space and a lower space. The components are disposed in the upper space, and the power supply is stored in the lower space, so that the components are integrated with the power supply to become a whole.

6. The fluid (such as water) can be added with essence. The present invention provides not only visual and auditory enjoyments but also olfactory enjoyment.

DETAILED DESCRIPTION OF THE PREFERRED EMBODIMENTS

Embodiments of the present invention will now be described, by way of example only, with reference to the accompanying drawings.

Figure 1:
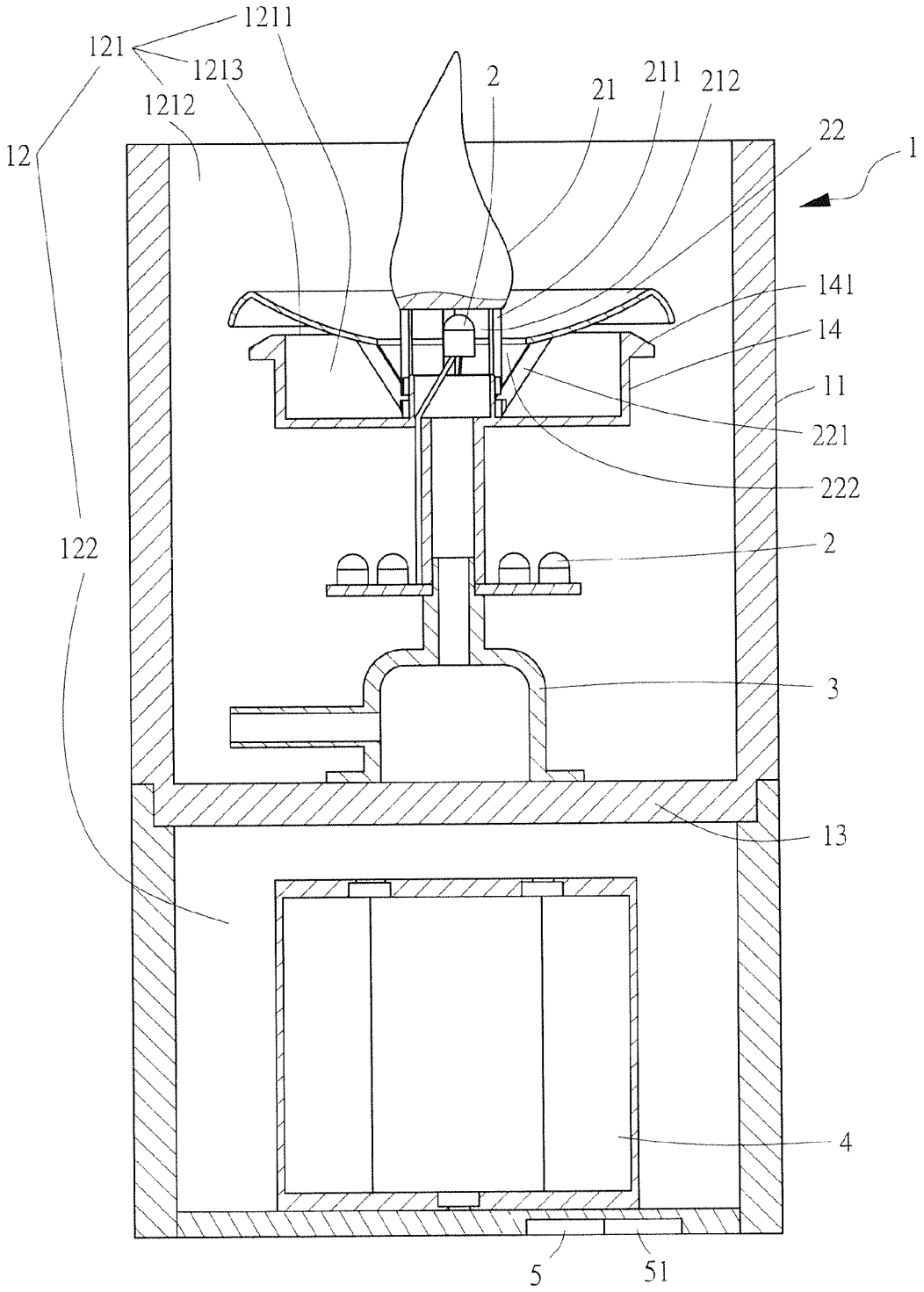
FIG. 1 is a sectional view according to a first embodiment of the present invention.

FIG. 1 shows a first embodiment of the present invention. This embodiment comprises a container 1. The container 1 has an outer wall 11 to surround an accommodation space 12 therein. The accommodation space 12 is divided into an upper space 121 and a lower space 122 by a first partition 13. The upper space 121 is divided into a first half portion 1211 and a second half portion 1212 by a second partition 14. The first half portion 1211 is in communication with the second half portion 1212 through an opening 1213. The opening 1213 and the first partition 13 of the container 1 have a height difference. The second partition 14 has a flange 141 thereon. The flange 141 and the first partition 13 of the container 1 have a height difference. In this embodiment, the second partition 14 is an encircling closed configuration, rendering the first half portion 1211 and the second half portion 1212 concentric. The first half portion 1211 is located inside, and the second half portion 1212 is located outside to surround the first half portion 1211. The second partition 14 is narrowed downward. The flange 141 faces the second half portion 1212. The outer wall 11 has a height higher than that of the second partition 14. At least one portion of the outer wall 11 of the container 1, corresponding to the upper space 121, is light-permeable. The second partition 14 is also light-permeable.

Figure 2:
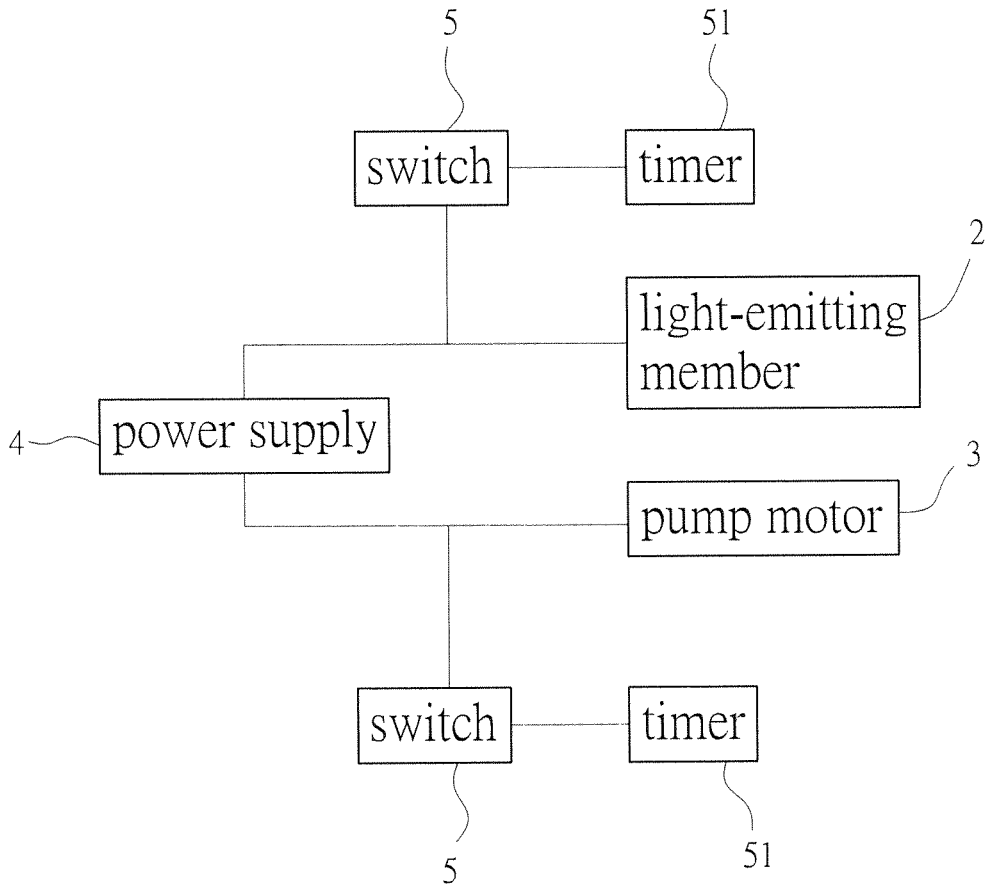
FIG. 2 is a block diagram of partial components according to the first embodiment of the present invention.

Referring to FIG. 1 and FIG. 2, this embodiment further comprises a light-emitting member 2 disposed on the container 1 and located in the upper space 121. The light-emitting member 2 is located in the second half portion 1212 close to a narrower portion of the second partition 14. Another light-emitting member 2 is disposed in the first half portion 1211 close to the opening 1213. A flame-shaped transparent or translucent shell 21 is located above the light-emitting member 2 which is disposed in the first half portion 1211 close to the opening 1213. An outer edge of the flame-shaped transparent or translucent shell 21 is provided with a dish-shaped transparent or translucent shell 22. The flame-shaped transparent or translucent shell 21 and the dish-shaped transparent or translucent shell 22 are supported on the second partition 14 through a support leg 211 and a support leg 221 respectively. Through holes 212, 222 are defined in the support legs 211, 221 for a fluid to pass therethrough. Preferably, the light-emitting members 2 are light-emitting diodes (LEDs). A pump motor 3 is disposed on the container 1 and located in the upper space 121. The pump motor 3 is in communication with the first half portion 1211 and the second half portion 1212. A power supply 4 is disposed on the container 1 and located in the lower space 122. The power supply 4 is electrically connected with the light-emitting members 2 and the pump motor 3. The power supply 4 comprises a battery. Furthermore, a switch 5 is connected between the power supply 4 and the light-emitting members 2 and connected between the power supply 4 and the pump motor 3. Furthermore, the switch 5 comprises a timer 51. Through the dual-layer configuration of the upper space 121 and the lower space 122 of the accommodation space 12, the components and the power supply 4 are integrated to become a whole to be carried conveniently.

Figure 3:
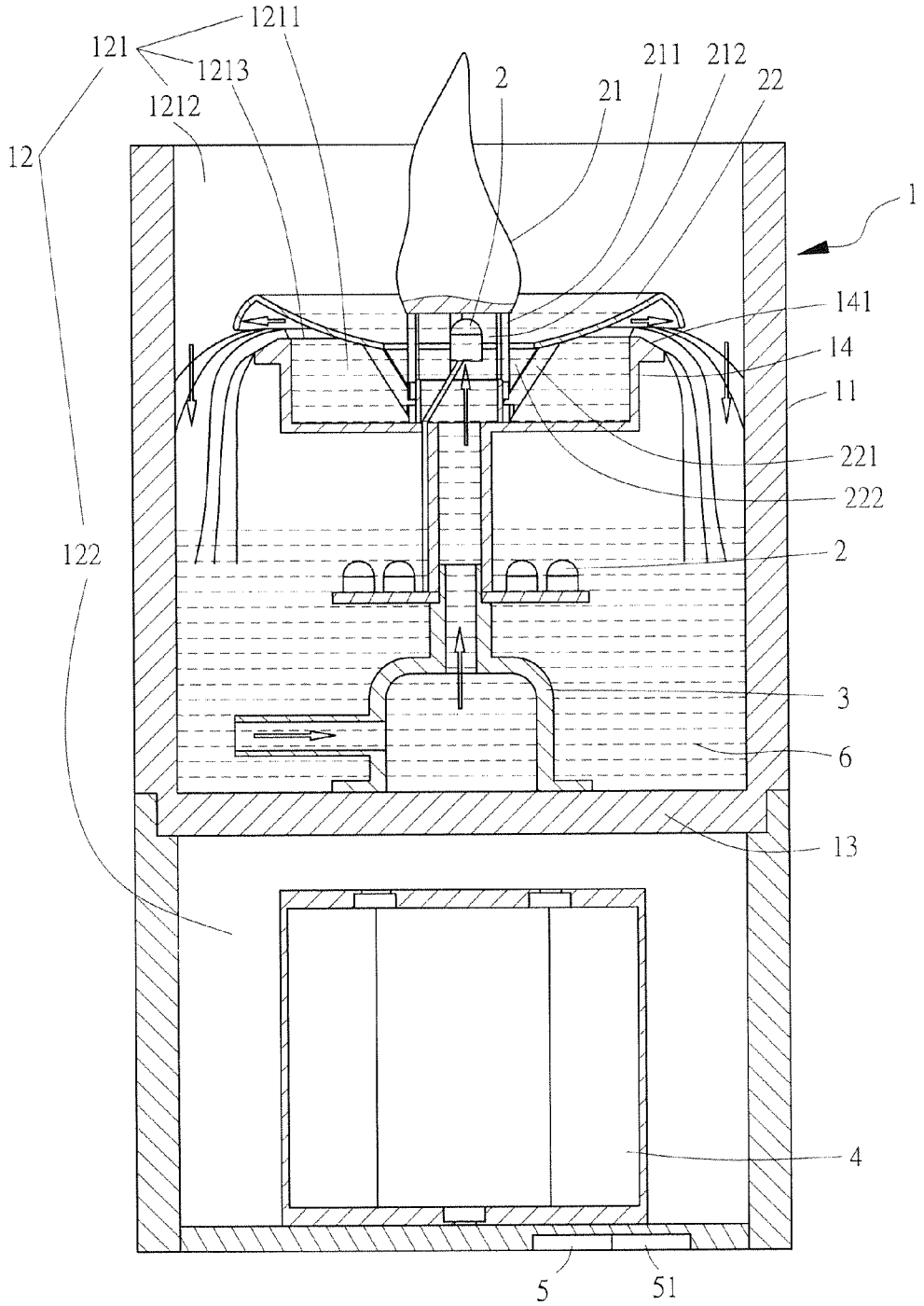
FIG. 3 is a schematic view according to the first embodiment of the present invention when in use.

Referring to FIG. 3, a fluid 6, such as water, is poured into the upper space 121. The switch 5 is turned on to activate the light-emitting members 2 and the pump motor 3. Through the pump motor 3, the fluid 6 is pumped from the low position of the second half portion 1212 to the first half portion 1211, and then flows back from the high position of the first half portion 1211 to the second half portion 1212, thereby the fluid 6 is circulated. When the fluid 6 overflows to the second half portion 1212, the water will be slightly beyond the opening 1213 to form a water column due to the motor power. The overflowing fluid 6 passes the flange 141 to fall like a waterfall and knock the outer wall 11 and the remaining fluid 6 within the second half portion 1212 to bring sound of water. The light radiated from the light-emitting member 2 located in the second half portion 1212 penetrates the flowing fluid 6 to present a change of light and shadow. The light radiated from the light-emitting member 2 disposed in the first half portion 1211 close to the opening 1213 forms a flame-like visual effect when penetrating the water column, thus presenting as candlelight. In particular, the light-emitting member 2 disposed in the first half portion 1211 is provided with the flame-shaped transparent or translucent shell 21. When the light penetrates the flame-shaped transparent or translucent shell 21, the light and shadow effect is enhanced and more similar to that of candlelight. In addition, when the overflowing fluid 6 passes the dish-shaped transparent or translucent shell 22, the fluid 6 in the dish-shaped transparent or translucent shell 22 presents the appearance similar to melting wax, providing a special vision for the user. When the present invention is used in a dim indoor environment, the light and shadow will flicker on the wall. The present invention provides sound and light effects and better sensory stimuli for the user. Furthermore, the fluid 6 can be added with essence, such as essential oil of flowers or plants, to spread fragrance during circulation of the fluid 6. The present invention provides not only visual and auditory enjoyments but also olfactory enjoyment. In addition, the timer 51 is used to set the running time of the light-emitting member 2 and the pump motor 3, having energy-saving and eco-friendly effects.

Figure 4:
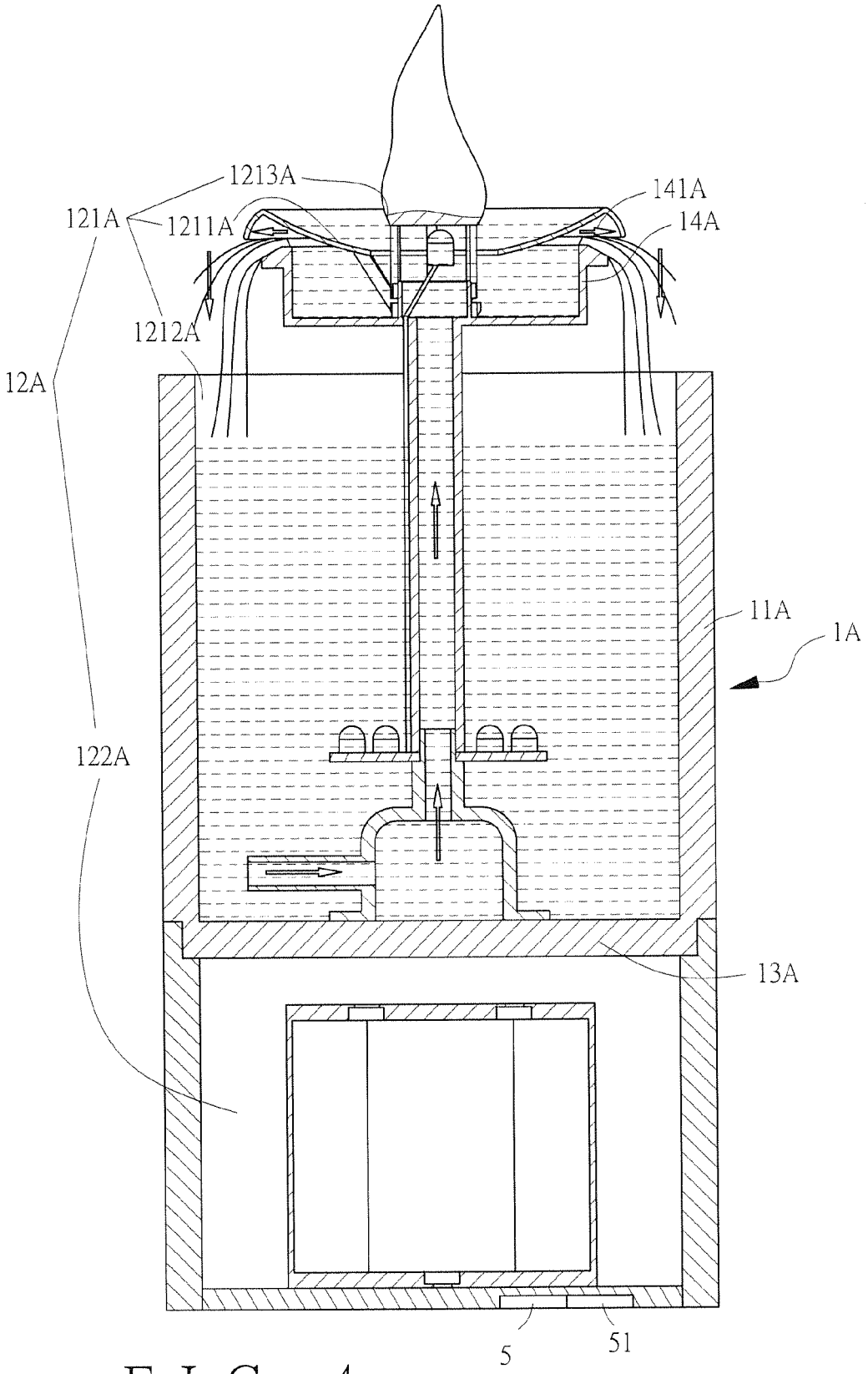
FIG. 4 is a schematic view according to a second embodiment of the present invention when in use.

FIG. 4 shows a second embodiment of the present invention. The second embodiment is substantially similar to the first embodiment with the exceptions described hereinafter. The second embodiment comprises a container 1A. The container 1A has an outer wall 11A to surround an accommodation space 12A therein. The accommodation space 12A is divided into an upper space 121A and a lower space 122A by a first partition 13A. The upper space 121A is divided into a first half portion 1211A and a second half portion 1212A by a second partition 14A. The first half portion 1211A is in communication with the second half portion 1212A through an opening 1213A. The second partition 14A has a flange 141A thereon. In this embodiment, the outer wall 11A has a height lower than that of the second partition 14A. Thus, the second embodiment provides a different sound and light effect.

Figure 5:
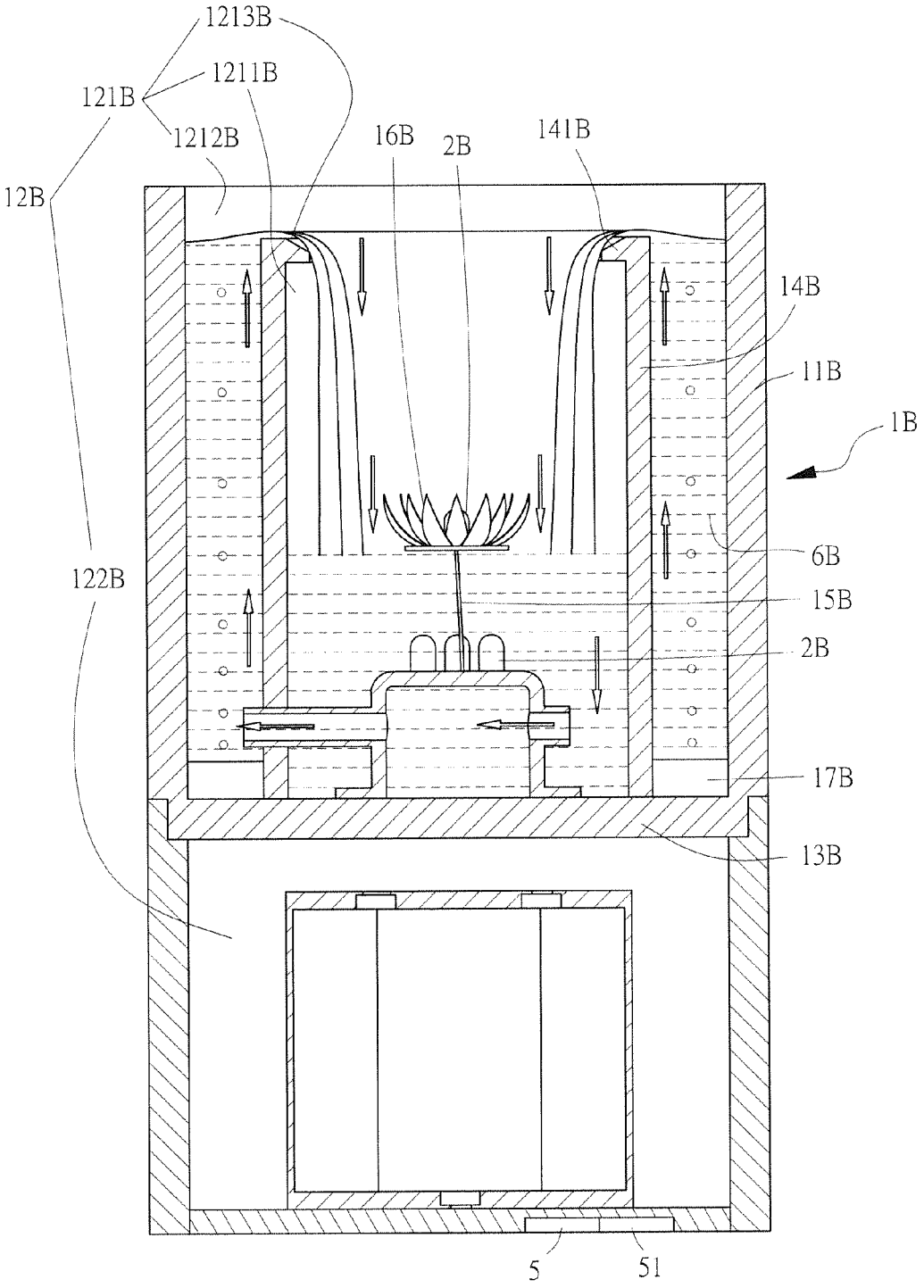
FIG. 5 is a schematic view according to a third embodiment of the present invention when in use.

FIG. 5 shows a third embodiment of the present invention. This embodiment comprises a container 1B. The container 1B has an outer wall 11B to surround an accommodation space 12B therein. The accommodation space 12B is divided into an upper space 121B and a lower space 122B by a first partition 13B. The upper space 121B is divided into a first half portion 1211B and a second half portion 1212B by a second partition 14B. The first half portion 1211B is in communication with the second half portion 1212B through an opening 1213B. The opening 1213B and the first partition 13B of the container 1B have a height difference. The second partition 14B has a flange 141B thereon. The flange 141B and the first partition 13B of the container 1B have a height difference. In this embodiment, the second partition 14B is an encircling closed configuration, rendering the first half portion 1211B and the second half portion 1212B concentric. The first half portion 1211B is located inside, and the second half portion 1212B is located outside to surround the first half portion 1211B. The flange 141B faces the first half portion 1211B. At least one portion of the outer wall 11B of the container 1B, corresponding to the upper space 121B, is light-permeable. This embodiment further comprises a connecting rope 15B. One end of the connecting rope 15B is connected with a floating decoration 16B and another end of the connecting rope 15B is fixed to the container 1B, such that the floating decoration 16B is located in the first half portion 1211B of the upper space 121B. A bubble generator 17B is provided in the second half portion 1212B. A light-emitting member 2B is disposed in the first half portion 1211B of the upper space 121B. Another light-emitting member 2B is disposed on the floating decoration 16B. When in use, a fluid 6B is pumped from the low position of the first half portion 1211B of the upper space 121B to the second half portion 1212B, and then flows back from the high position of the second half portion 1212B to the first half portion 1211B, thereby the fluid 6 is circulated. In the course in which the fluid 6B overflows to the first half portion 1211B, the fluid 6B will pass the flange 141B to fall as a waterfall. Thereby, the third embodiment provides a different sound and light effect. The floating decoration 16B can flow along with the fluid 6B. The bubble generator 17B generates bubbles floating from bottom to top, increasing enjoyment.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A flameless candle device with a fountain, comprising:

a container having an outer wall to surround an accommodation space therein, the accommodation space being divided into a first half portion and a second half portion by a partition, the first half portion being in communication with the second half portion through an opening, the opening and a bottom of the container having a height difference, the partition having a flange thereon, the flange and the bottom of the container having a height difference;

a first light-emitting member disposed in the first half portion close to the opening;

a flame-shaped transparent or translucent shell located above said first light-emitting member;

a second light-emitting member located in the accommodation space;

a pump motor in communication with the first half portion and the second half portion of the accommodation space; and a power supply electrically connected with the second light-emitting member and the pump motor.

2. The flameless candle device as claimed in claim 1, wherein the outer wall has a height higher than that of the partition.

3. The flameless candle device as claimed in claim 1, wherein the outer wall has a height lower than that of the partition.

4. The flameless candle device as claimed in claim 1, wherein the partition has an encircling closed configuration, rendering the first half portion and the second half portion concentric.

5. The flameless candle device as claimed in claim 4, wherein the flange faces the first half portion.

6. The flameless candle device as claimed in claim 4, wherein the flange faces the second half portion.

7. The flameless candle device as claimed in claim 4, further comprising a connecting rope, one end of the connecting rope being connected with a floating decoration and another end of the connecting rope being fixed to the container so that the floating decoration is located in the first half portion of the accommodation space.

8. The flameless candle device as claimed in claim 4, wherein the partition includes a wider portion and a narrower portion, the narrower portion below the wider portion, and the second light-emitting member is located in the second half portion close to the narrower portion of the partition.

9. The flameless candle device as claimed in claim 1, further comprising a dish-shaped transparent or translucent shell located at an outer edge of the flame-shaped transparent or translucent shell.

10. The flameless candle device as claimed in claim 1, wherein the outer wall of the container and the partition are light-permeable.

11. The flameless candle device as claimed in claim 1, wherein the power supply includes a battery.

12. The flameless candle device as claimed in claim 1, wherein the second light-emitting member is a light-emitting diode.

13. The flameless candle device as claimed in claim 1, further comprising a switch connected between the power supply and the second light-emitting member and connected between the power supply and the pump motor.

14. The flameless candle device as claimed in claim 13, wherein the switch includes a timer.

15. The flameless candle device as claimed in claim 1, wherein a fluid is poured into the accommodation space, and the fluid is mixed with essence.

16. The flameless candle device as claimed in claim 1, wherein a bubble generator is provided in the accommodation space.

17. A flameless candle device with a fountain, comprising:

a container having an outer wall to surround an accommodation space therein, the accommodation space being divided into an upper space and a lower space by a first partition, the upper space being divided into a first half portion and a second half portion by a second partition, the first half portion being in communication with the second half portion through an opening, the opening and the first partition of the container having a height difference, the second partition having a flange thereon, the flange and the first partition of the container having a height difference;

a first light-emitting member disposed in the first half portion of the upper space close to the opening;

a flame-shaped transparent or translucent shell located above said second light-emitting member;

a second light-emitting member disposed on the container and located in the upper space;

a pump motor disposed on the container and located in the upper space, the pump motor being in communication with the first half portion and the second half portion; and a power supply disposed on the container and located in the lower space, the power supply being electrically connected with the second light-emitting member and the pump motor.

* * * * *